US010122099B2

(12) United States Patent
Dold et al.

(10) Patent No.: US 10,122,099 B2
(45) Date of Patent: Nov. 6, 2018

(54) DISTRIBUTOR BLOCK WITH CONTACT GUARD

(71) Applicant: Friedrich Goehringer Elektrotechnik GmbH, Triberg (DE)

(72) Inventors: Ronald Dold, Schoenwald (DE); Friedbert Gerwin Bruetsch, Tuttlingen (DE)

(73) Assignee: Friedrich Goehringer Elektrotechnik GmbH, Triberg (DE)

( * ) Notice: Subject to any disclaimer, the term of this patent is extended or adjusted under 35 U.S.C. 154(b) by 0 days.

(21) Appl. No.: 15/262,878

(22) Filed: Sep. 12, 2016

(65) Prior Publication Data

US 2017/0155201 A1 Jun. 1, 2017

(30) Foreign Application Priority Data

Oct. 1, 2015 (DE) ..... 10 2015 116 716

(51) Int. Cl.

| | |
|---|---|
| ***H01R 9/24*** | (2006.01) |
| ***H01R 9/22*** | (2006.01) |
| ***H01R 9/03*** | (2006.01) |
| ***H01R 13/447*** | (2006.01) |
| ***H01R 13/58*** | (2006.01) |

(52) U.S. Cl.

CPC ..... *H01R 9/2416* (2013.01); *H01R 9/032* (2013.01); *H01R 9/223* (2013.01); *H01R 13/447* (2013.01); *H01R 13/5837* (2013.01)

(58) Field of Classification Search

CPC ..... H01R 13/4532; H01R 13/4534; H01R 13/4538; H01R 13/453; H01R 9/2416; H01R 9/223

USPC ..... 439/709, 113, 134, 139, 141, 142

See application file for complete search history.

(56) References Cited

U.S. PATENT DOCUMENTS

| | | | | |
|---|---|---|---|---|
| 3,068,442 | A * | 12/1962 | Kubik | H01R 13/447 174/67 |
| 4,640,564 | A * | 2/1987 | Hill | H01R 13/447 439/137 |
| 5,584,712 | A * | 12/1996 | Fukushima | H01R 13/4538 439/140 |
| 5,998,735 | A * | 12/1999 | Patterson, Jr. | H02G 3/14 174/67 |
| 7,637,756 | B1 * | 12/2009 | Hsu | H01R 13/4534 439/137 |
| 8,197,282 | B1 * | 6/2012 | Su | H01R 13/6587 439/540.1 |
| 8,704,092 | B2 * | 4/2014 | Zhang | H01R 13/4534 174/66 |

(Continued)

FOREIGN PATENT DOCUMENTS

| | | |
|---|---|---|
| DE | 20 2011 000 244 U1 | 3/2011 |
| WO | WO 01/80259 A1 | 10/2001 |

*Primary Examiner* — Harshad C Patel

(74) *Attorney, Agent, or Firm* — William Gray Mitchell

(57) ABSTRACT

The invention is a distributor block for connecting several electric connection cables starting from an electric inlet cable with an electric isolating housing as well as an electrically conducting terminal block, which is arranged in the housing, with at least one inlet opening being arranged in the housing for the inlet cable, with the distributor block showing an electrically isolating, articulate contact guard, which at least partially can cover the inlet opening.

12 Claims, 5 Drawing Sheets

(56) References Cited

U.S. PATENT DOCUMENTS

| | | | | |
|---|---|---|---|---|
| 8,845,345 | B2 * | 9/2014 | Gattwinkel | H01R 13/4534 439/137 |
| 2007/0039973 | A1 * | 2/2007 | Boenig | A45C 13/005 220/847 |
| 2012/0244730 | A1 * | 9/2012 | Grimm | H01R 9/2425 439/142 |
| 2014/0011380 | A1 | 1/2014 | Gattwinkel | |
| 2016/0248189 | A1 * | 8/2016 | Arnesson | H01R 13/4534 |

* cited by examiner

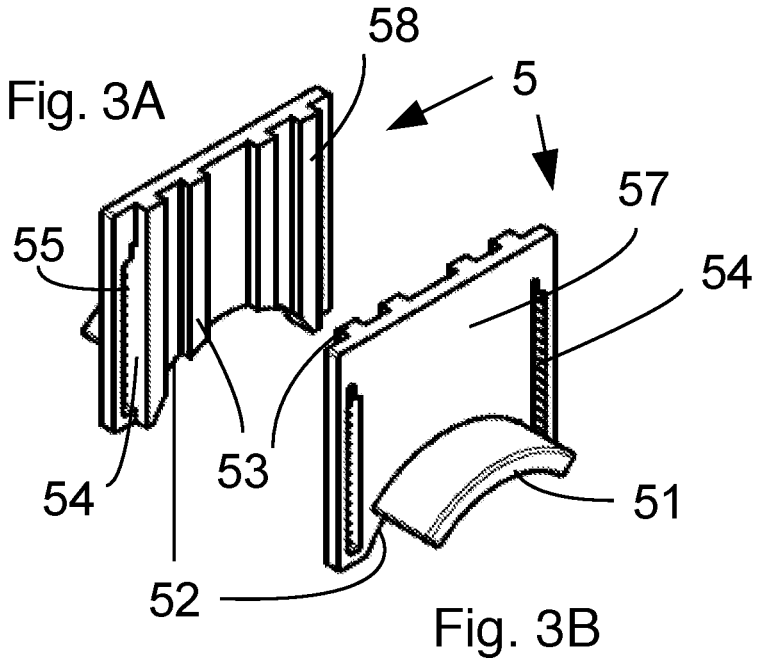
Fig. 3A
Fig. 3B
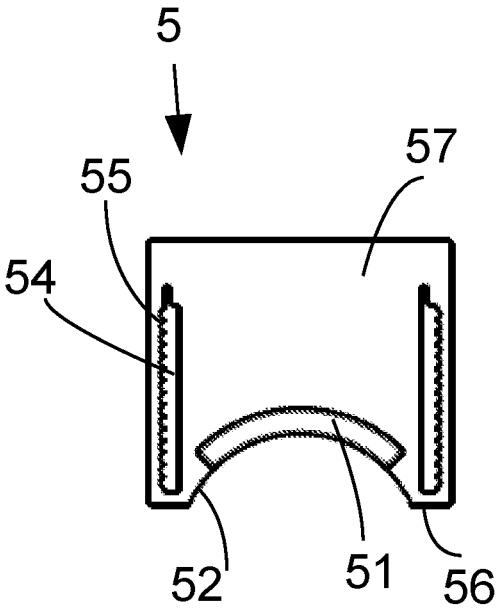
Fig. 3C

DISTRIBUTOR BLOCK WITH CONTACT GUARD

CROSS REFERENCE TO RELATED APPLICATIONS

This patent application claims priority to German Patent Application 10 2015 116 716.6, filed on Oct. 1, 2015.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to a distributor block with a contact guard.

Background of the Invention

Distributor blocks are known for connecting several electric connection cables starting at an electric input cable. Distributor blocks usually comprise an electrically isolating housing as well as an electrically conductive terminal block, which is arranged inside the said housing. Additionally, at least one input opening is provided in the housing for an input cable.

Commonly the input opening shows a diameter which is selected so that cables with different diameters can be connected. This way the distributor block is suitable not only for a particular diameter of the input cable, which offers high flexibility when selecting the cable.

In distributor blocks of prior art, it is considered disadvantageous that in the event the input cable shows a considerably smaller diameter than the input opening, here an opening remains clear at the input opening through which the terminal block inside the distributor block, impinged with voltage, is exposed. In particular, objects and especially fingers can penetrate, which is very dangerous for a user.

The objective of the invention is therefore to provide a secure distributor block. The objective is attained in a distributor block with the features as described herein.

BRIEF SUMMARY OF THE INVENTION

In a preferred embodiment, a distributor block (1) for connecting several electric connection cables starting at an electric inlet cable with an electrically isolating housing (2) as well as an electrically conductive terminal block (6), which is arranged in the housing (2), with at least one inlet opening (20) being arranged in the housing (2) for the inlet cable, characterized in that the distributor block (1) comprises an electrically isolating, articulate contact guard (5) which can at least partially cover the inlet opening (20).

In another preferred embodiment, a distributor block (1) as described herein, characterized in that the contact guard (5) is adjustable or displaceable along an axis (A).

In another preferred embodiment, a distributor block (1) as described herein, characterized in that the contact guard (5) is pivotal or rotational.

In another preferred embodiment, a distributor block (1) as described herein, characterized in that the contact guard (5) comprises an attachment (51) pointing outwardly, which is suitable for the manual movement of the contact guard (5).

In another preferred embodiment, a distributor block (1) as described herein, characterized in that the contact guard (5) can be fixed in reference to the housing (2) by a latch arrangement (8) at a plurality of positions.

In another preferred embodiment, a distributor block (1) as described herein, characterized in that the latch arrangement (8) comprises at least one oblong hole (54) with inward pointing cams (55), with at least one oblong hole respectively cooperating with at least one latching cam (43).

In another preferred embodiment, a distributor block (1) as described herein, characterized in that the contact guard (5) comprises two lateral oblong holes (54) with inward pointing cams (55) and the housing (2) respectively comprising one oblong hole (54) for a corresponding latching cam (43).

In another preferred embodiment, a distributor block (1) as described herein, characterized in that the contact guard (5) and the housing (2) are adjusted to each other such that in a completely open position of the contact guard (5) an opening remains at the inlet opening (20), which is circular.

In another preferred embodiment, a distributor block (1) as described herein, characterized in that the contact guard (5) comprises an arc-shaped recess (52).

In another preferred embodiment, a distributor block (1) as described herein, characterized in that the inlet opening (20) of the housing (2) is essentially formed like a circle, with the inlet opening (20) comprising an additional recess (21) in which the attachment (51) of the contact guard (5) can be arranged in the open position.

In another preferred embodiment, a distributor block (1) as described herein, characterized in that the contact guard (5) comprises reinforcing ribs (53).

In another preferred embodiment, a distributor block (1) as described herein, characterized in that the housing (2) comprises a housing body (3) and a cover (4), with the cover (4) at least partially covering at least a first wall (32) of the housing body (3).

In another preferred embodiment, a distributor block (1) as described herein, characterized in that the housing body (2) shows a first opening (30) at the first wall (32) and the cover (4) shows a second opening (41), with the opening (41) of the cover (4) overlapping the opening (30) of the housing body (3) such that both openings (31, 41) form the inlet opening (20) of the housing (2) for the inlet cable.

BRIEF DESCRIPTION OF THE DRAWINGS

FIG. 3A is a line drawing evidencing the contact guard of the distributor block of FIG. 1 in a perspective view from the rear.

FIG. 3B is a line drawing evidencing the contact guard of the distributor block of FIG. 1 in a perspective view from the front.

FIG. 3C is a line drawing evidencing a front view of the contact guard of the distributor block of FIG. 1.

DETAILED DESCRIPTION OF THE INVENTION

Figure 1:
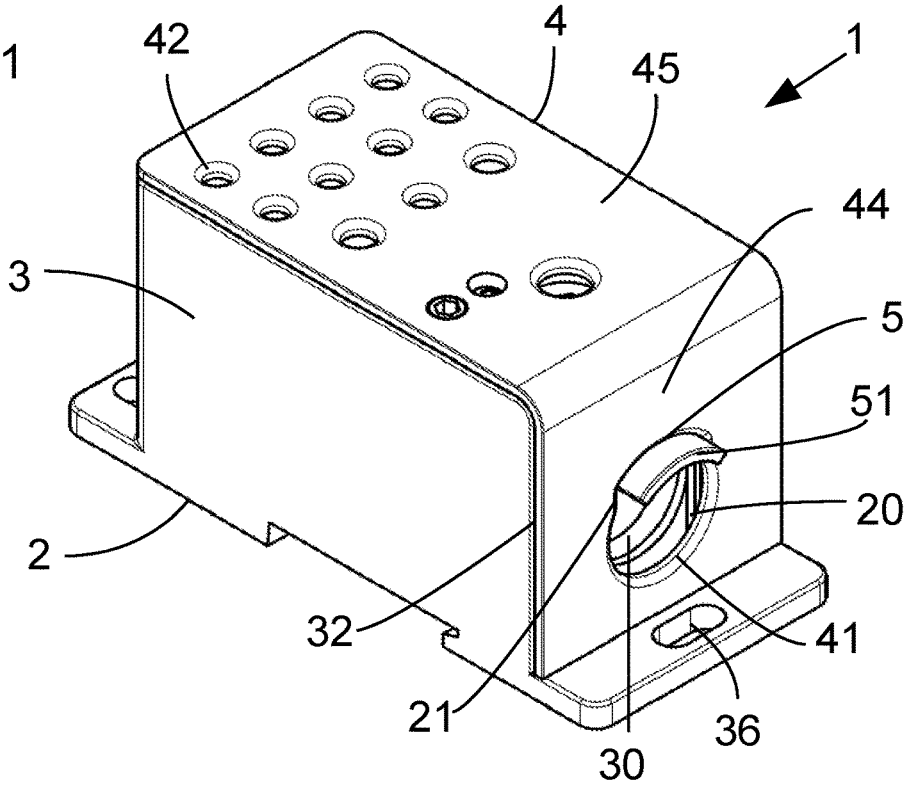
FIG. 1 is a line drawing evidencing an exemplary embodiment of a distributor block in a perspective view from the front.

The distributor block according to the invention for connecting several electric connection cables, starting from an electric input cable, comprises an electrically isolating housing as well as an electrically conductive terminal block, which is arranged inside the housing. For this purpose, at least one input opening is arranged in the housing for the input cable. Further, the distributor block comprises an electrically isolating, articulate contact guard, which can at least partially cover the input opening. This way the distributor block is secured. In particular, the diameter of the input opening can be reduced and/or adjusted to the diameter of the connection cable such that small objects, particularly fingers, cannot penetrate through the input opening.

Preferably the contact guard is adjustable along an axis or displaceable. Alternatively, the contact guard may be pivotal or rotational. This way, the diameter of the input opening can be adjusted by a simple motion of the contact guard.

It is particularly advantageous when the contact guard comprises an outward pointing attachment, which is suitable for manual movement of the contact guard. The user can therefore manually operate the contact guard very easily from the outside, and this way the diameter of the remaining opening is reduced.

The contact guard can be fixed in a plurality of positions in reference to the housing using a latch arrangement. This way the contact guard is a particularly safe one. In particular, the contact guard can be blocked in the desired position such that any movement only occurs upon a desired operation of the arrangement and not automatically, for example due to vibrations.

Advantageously the latch arrangement comprises at least one oblong hole with inward pointing cams, with at least one oblong hole respectively cooperating with at least one latching cam. This way, several positions of the contact guard can be set along the longitudinal extension of the oblong hold so that an adjustment to most different cable diameters can be achieved in a simple fashion.

According to a particularly advantageous embodiment the contact guard shows two lateral oblong holes with inward pointing cams, and the housing shows a corresponding latching cam for each oblong hole. When using two, preferably parallel, latch arrangements, the adjustments can be selected securely and stably, ensuring safe guidance of the contact guard.

The contact guard and the housing can be adjusted to each other such that in a completely open position of the contact guard the opening remaining at the inlet opening is circular. In the open position of the contact guard here a maximum diameter is available for an input cable.

Preferably the contact guard comprises an arc-shaped recess, allowing for adjustment of the cross-section of the remaining opening at the inlet opening to various diameters of the inlet cable. In particular, the remaining opening at the inlet opening can be kept as small as possible in order to ensure optimal protection.

It is particular advantageous for the inlet opening of the housing to be essentially embodied in a circular fashion, with the inlet opening comprising an additional recess, in which the attachment of the contact guard is arranged in the open position. This forms a very space-saving setting of the contact guard in the completely opened position, particularly when the inlet cable shows a large diameter.

The contact guard may show reinforcing ribs, by which additionally a certain distance can be maintained from the housing. This way, a stable arrangement is yielded and the contact guard can be guided safely between the housing and the cover.

In a particularly advantageous embodiment the housing comprises a housing body and a cover, with the cover at least partially covering a first wall of the housing body. With the cover, here easy access to the terminal block can be ensured. Further, the cover can encompass the housing body, particularly when the cover is formed in an L-shaped fashion, and the contact guard can be arranged and supported between the cover and the housing body, for example.

Preferably the housing body shows a first opening at the first wall and the cover shows a second opening, with the opening of the cover overlapping the opening of the housing body such that both openings form the input opening for the input cable. This way, the cover forms a double barrier in the feeding section.

It is particularly advantageous for the housing body and the cover to be potentially connected via a dovetail guide. This represents a simple and stable option for connection.

The contact guard can then be arranged between the housing body and the cover, as already indicated. This represents a space-saving and stable arrangement of the contact guard.

Preferably the latching cams are arranged at the cover and the reinforcing ribs of the contact guard against the first wall of the housing body. The contact guard can this way be arranged on the one hand at the cover using the latching cams, and then the cover can be arranged via the dovetail guide at the housing body.

DETAILED DESCRIPTION OF THE FIGURES

Figure 2:
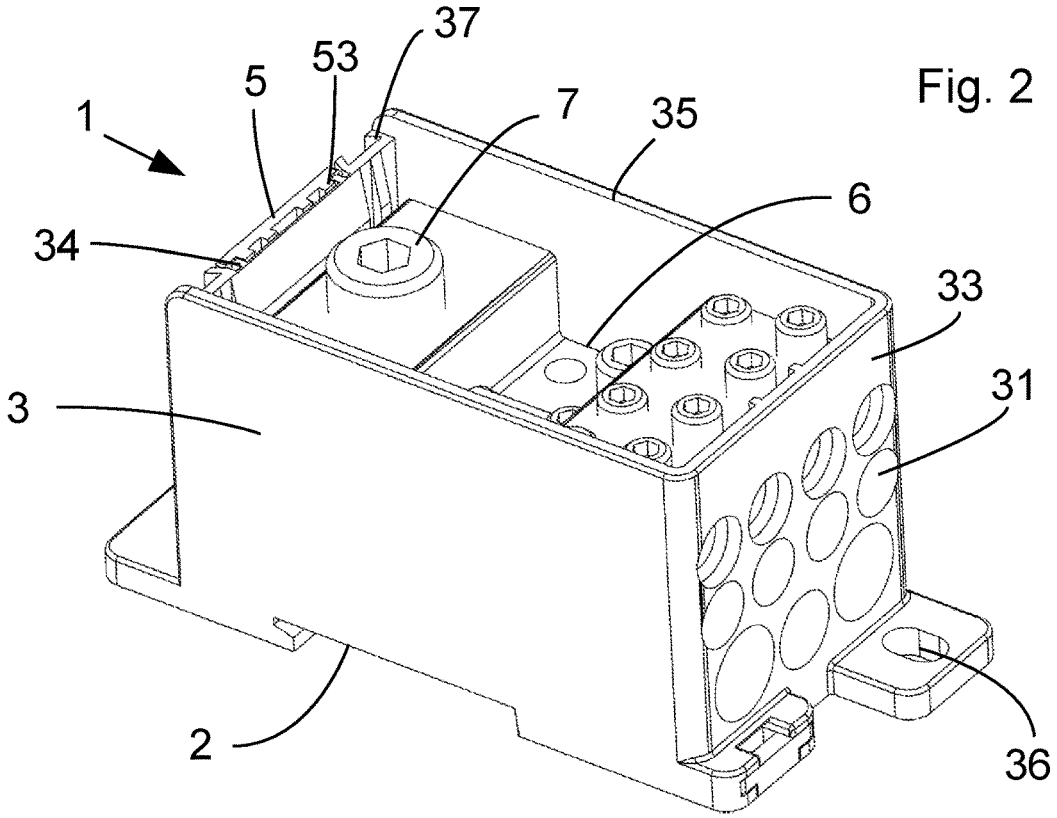
FIG. 2 is a line drawing evidencing the distributor block of FIG. 1 in a perspective view from the rear, without a cover.

FIGS. 1 and 2 show a perspective view of an exemplary embodiment of a distributor block 1 from the front (FIG. 1) and from the rear without a cover (FIG. 2).

The distributor block 1 comprises a housing 2, which shows a housing body 3 and a cover 4, a terminal block 6 arranged in the housing 2, as well as a contact guard 5.

The housing 2 is essentially formed as a cuboid and shows an inlet opening 20 at the front for inserting an inlet cable, not shown in greater detail. The housing 2 can be fastened by fixing means, particularly screws, at another fixed part. The fixing means may be inserted into holes 36, which are provided in flaps arranged at a lower side of the housing.

Additionally or alternatively, fastening means may also be provided to be arranged at the distributor block 1 on a cap rail.

The housing body 3 is essentially embodied as a cuboid, with the housing body at a first wall 32 showing a circular opening 30 and at an upper wall, adjacent to the first wall 32, showing an opening 35, through which the terminal block 6 can be inserted. At a second wall 33, opposite the first wall 32, the housing body 3 comprises a plurality of outlet openings 31, in the present case eleven, for the outlet cables.

The cover 4 is essentially formed in an L-shaped fashion and comprises a first wall 44 and a second wall 45. The first wall 44 of the cover 4 covers the first wall 32 of the housing body 3 in the closed state of the housing 2 and shows an opening 41 which forms with the opening 30 of the housing body 3 the inlet opening 20 of the housing 2. The second wall 45 of the cover 4 closes the opening 35 of the upper wall of the housing body 3 and shows a plurality of openings 42, in the present case twelve, through which the connection cables can be fixed via clamping means, in the present case by clamping screws 7.

The terminal block 6 is arranged in the housing body 3, which is covered by the cover 4. The terminal block 6 comprises an inlet opening, not shown in greater detail, for the inlet connection cable, which overlaps the inlet opening 20 of the housing 2, outlet openings for the cables, not shown in greater detail, which respectively overlap with one of the outlet openings 31 of the housing body 3, as well as openings for the clamping screws 7, not shown in greater detail, which overlap respectively one of the openings 42 of the cover 4.

A contact guard 5 is arranged between the first wall 32 of the housing body 3 and the first wall 44 of the cover 4, which is explained in greater detail based on FIGS. 3A-3C.

FIGS. 3A-3C respectively show a perspective view from the rear, a perspective view from the front, and a front view of the contact guard 5 of the distributor block 1.

The contact guard 5 is essentially embodied as a square plate with a front side 57 and a rear side 58 opposite the front side 57, with the contact guard 5 at one edge 56 of the front side 57 showing an arc-shaped recess 52. The recess 52 extends over the entire length of the edge 56. An arc-shaped attachment 51 is formed along a portion of the recess 52, which is adjusted to said recess 52 and extends perpendicular to the front 57 of the contact guard 5. The contact guard 5 further comprises two oblong holes 54 with inwardly pointing cams 55, which extend perpendicular in reference to the edge 56 and are arranged laterally in reference to the recess 52. Four reinforcement ribs 53 are arranged at the rear 58 between the oblong holes 55, with ribs extending parallel in reference to the oblong holes 55. The reinforcing ribs 53 show a rectangular cross-section and extend over the entire length of the rear side 58. The contact guard 5 additionally comprises an axis of symmetry which is perpendicular in reference to the edge 56 in one level of the plate.

Other forms of holes and cams are though also possible.

Figure 4:
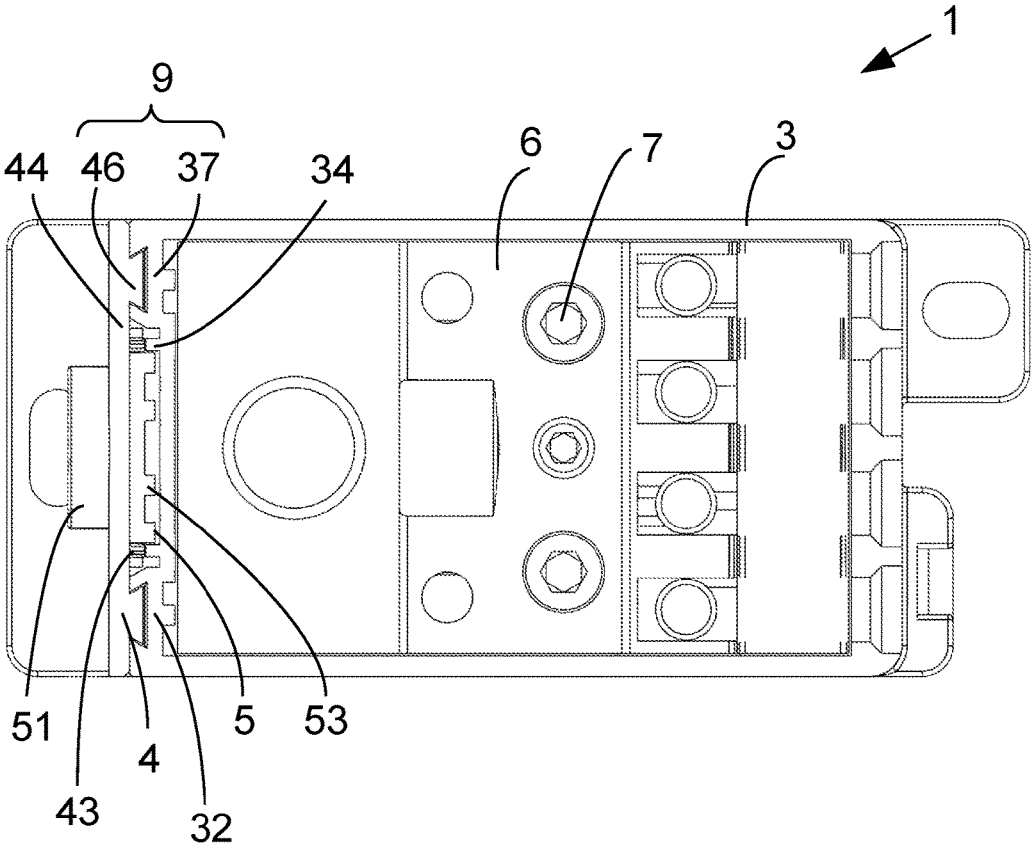
FIG. 4 is a line drawing evidencing a cross-section from the top through the distributor block of FIG. 1.
Figure 5:
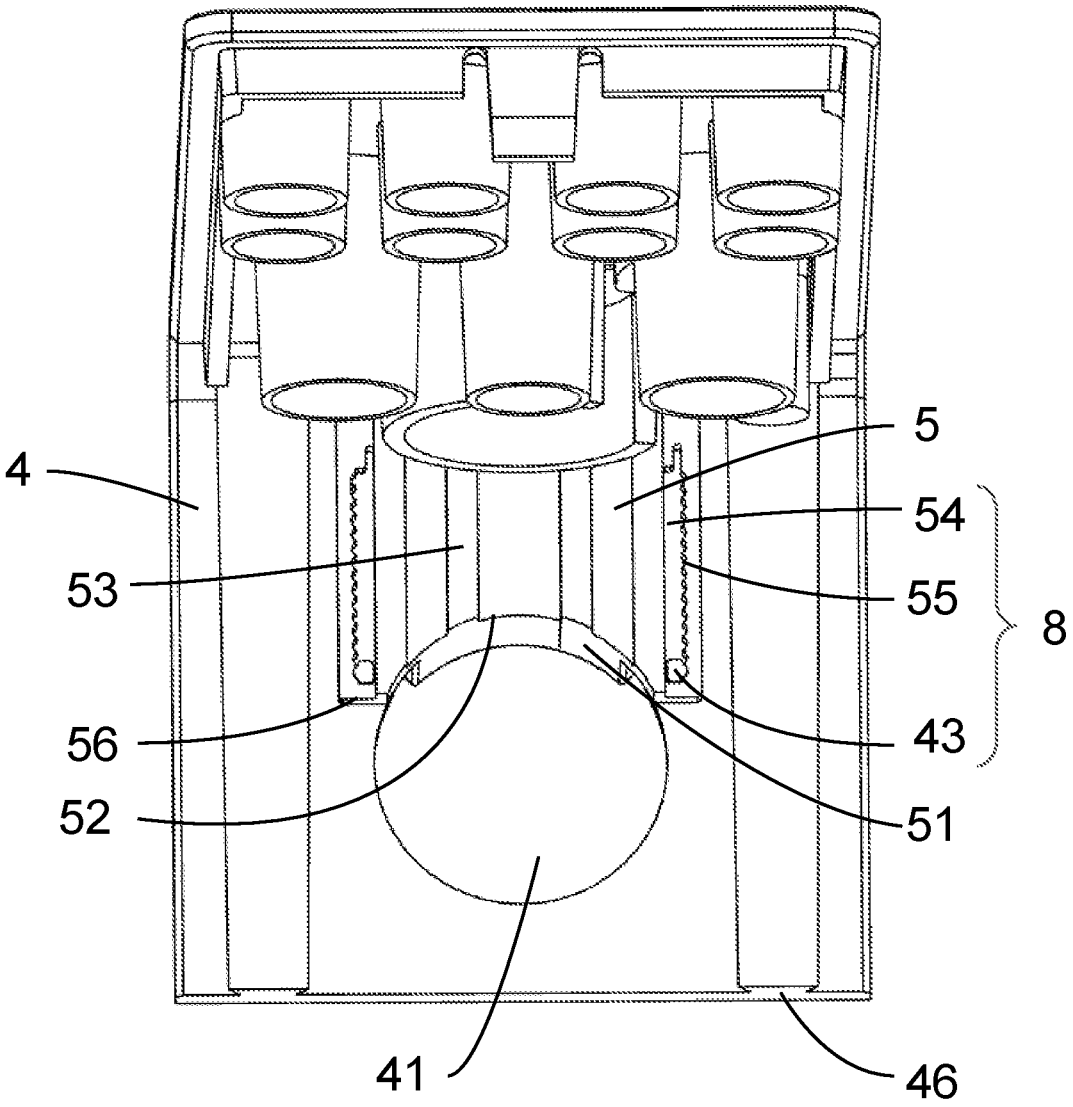
FIG. 5 is a line drawing evidencing a rear view of the cover and the contact guard of the distributor block of FIG. 1.

The arrangement of the contact guard 5 in the housing 2 is explained based on FIGS. 4 and 5. FIG. 4 shows a cross-section from the top through the distributor block 1 and FIG. 5 shows a rear view of the cover and the contact guard 5 of the distributor block 1.

The contact guard 5 is arranged between the housing body 3 and the cover 4, with the reinforcing ribs 53 of the contact guard 5 pointing towards the first wall 32 of the housing body 3 and the attachment 51 of the contact guard points in the opposite direction of the first wall 32. The cover 4 comprises a trapezoidal groove 46 at a side of the first wall 44 pointing inwardly, which can be inserted into an also adjusted trapezoidal formed section 37 of the first wall 32 of the housing body 3. This way, a dovetail guide 9 is formed between the housing body 3 and the cover 4.

The housing body 3 shows reinforcing ribs 34 at its first wall 32, which cooperate with the reinforcing ribs 53 of the contact guard 5 and ensure a centered alignment of the contact guard 5. In order to allow an articulate arrangement of the contact guard 5, for this purpose the cover 4 shows two latching cams 43 at the inwardly pointing side of the first wall 44, embodied as attachments pointing inwardly, engaging oblong holes 54 and cooperating with the cams 55 of one of the two oblong holes 54 of the contact guard 5 such that the contact guard 5 is held in different opening settings. In particular, the latching cams 43 are symmetrical in reference to the axis of symmetry of the contact guard 5 and arranged laterally in reference to the opening 41. This way a latching arrangement 8 is formed between the cover 4 and the contact guard 5. By this latching arrangement 8 the contact guard 5 can gradually be moved between different latching positions.

Figure 6A:
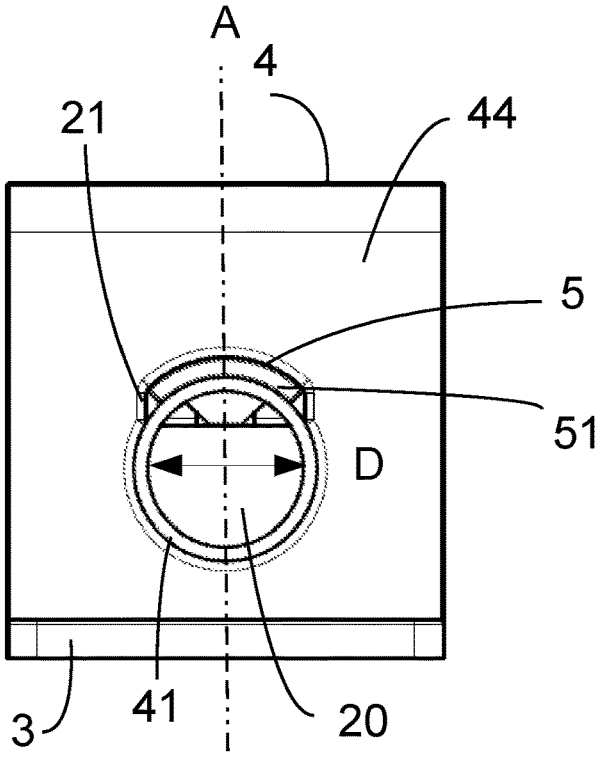
FIG. 6A is a line drawing evidencing a front view of the distributor block of FIG. 1 in a first, completely opened position of the contact guard.
Figure 6B:
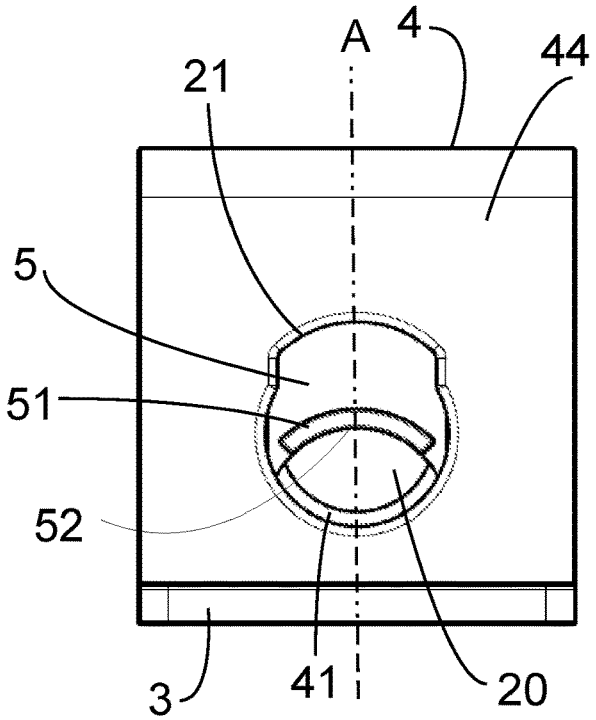
FIG. 6B is a line drawing evidencing a front view of the distributor block of FIG. 1 in a second position of the contact guard.

This motion is explained based on FIGS. 6A and 6B. It is also possible to arrange the latching cams 43 at the housing body 3 or the terminal block 6.

FIGS. 6A and 6B show a front view of the distributor block 1, each in a first completely opened position and in a second partially opened position of the contact guard 5. It is particularly clearly discernible in the figures that the opening 41 of the cover 4 is essentially circular, whereby the opening 41 comprises an additional arc-shaped recess 21 pointing in the direction of the second wall 45 of the cover. In the completely opened position of the contact guard 5 here the attachment 51 is received in the recess 21 in a form-fitting fashion. When opening the contact guard 5 additionally the attachment 51 abuts a boundary of the recess 21 such that the completely opened position of the contact guard 5 is predetermined.

The recess 21 and the attachment 51 are adjusted to each other such that in the open position of the contract guard 5 an opening remaining at the inlet opening 20, which is formed circular and shows a diameter D. This way, an inlet cable with a maximum diameter D, not shown in greater detail, can be inserted into the inlet opening 20.

A manually adjusted position of the contact guard 5 is secured against automatic closure by the latch arrangement 8. When the diameter of the inlet cable is smaller than the maximum diameter D, here the user or the electrician can manually move the contact guard 5 via the attachment 51 and this way adjust the clear area of the inlet opening 20 remaining to the smaller diameter. This motion occurs in this case via the latch arrangement 8 along an axis A, which extends parallel to the oblong holes 54 of the contact guard 5. By the latch arrangement 8 the contact guard 5 can be held in different settings, for example in the setting shown in FIG. 6B. When the user pushes the contact guard 5 along the axis A towards the bottom, the maximum diameter D of the inlet opening 20 is reduced and can therefore be adjusted to the inlet cable. In particular, the inlet cable can be fixed between an edge of the inlet opening 20 and the recess 52 and/or the attachment 51. In the present exemplary embodiment the contact guard 5 can be moved linearly along the axis A and/or displaced. Other motions of the contact guard 5 are also possible. For example, the contact guard 5 may be pivotal or rotational.

LIST OF REFERENCE NUMBERS

1 Distributor block
2 Housing

3 Housing body
4 Cover
5 Contact guard
6 Terminal block
7 Terminal screw
8 Latch arrangement
9 Dovetail guide
20 Inlet opening
21 Recess
30 Opening
31 Outlet opening
32 First wall
33 Second wall
34 Reinforcing ribs
35 Opening
36 Hole
37 Attachment
41 Opening
42 Opening
43 Latching cam
44 First wall
45 Second wall
46 Groove
51 Attachment
52 Recess
53 Reinforcing rib
54 Oblong hole
55 Cam
56 Edge
57 Front side
58 Rear side
A Axis
D Diameter The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. A distributor block for connecting several electric connection cables starting at an electric inlet cable, comprising an electrically isolating housing as well as an electrically conductive terminal block, wherein the terminal block is arranged within the housing, with at least one inlet opening being arranged in the housing for the inlet cable, wherein the distributor block comprises an electrically isolating, articulate contact guard comprising contact guard reinforcing ribs which intermesh with corresponding housing reinforcing ribs, thereby mounting the contact guard on the exterior of a first wall of the housing, thus allowing the contact guard to at least partially cover the inlet opening;

wherein the contact guard can be fixed in reference to the housing by a latch arrangement at a plurality of positions; wherein the latch arrangement comprises at least one oblong hole with inward pointing cams, with at least one oblong hole respectively cooperating with at least one latching cam; and the contact guard comprises two lateral oblong holes with inward pointing cams and the housing respectively comprising one oblong hole for a corresponding latching cam.

2. The distributor block according to claim 1, wherein the contact guard is adjustable or displaceable along an axis.

3. The distributor block according to claim 1, wherein the contact guard is pivotal or rotational.

4. The distributor block according to claim 1, wherein the contact guard comprises an attachment pointing outwardly, for the manual movement of the contact guard.

5. The distributor block according to claim 1, wherein the contact guard and the housing are adjusted to each other such that in a completely open position of the contact guard an opening remains at the inlet opening, which is circular.

6. The distributor block according to claim 1, wherein the contact guard comprises an arc-shaped recess.

7. The distributor block according to claim 1, wherein the inlet opening of the housing is essentially formed like a circle, with the inlet opening comprising an additional recess in which the attachment of the contact guard can be arranged in the open position.

8. The distributor block according to claim 1, wherein the housing comprises a housing body and a cover, with the cover at least partially covering at least a first wall of the housing body.

9. The distributor block according to claim 8, wherein the housing body shows a first opening at the first wall and the cover shows a second opening, with the opening of the cover overlapping the opening of the housing body such that both openings form the inlet opening of the housing for the inlet cable.

10. The distributor block according to claim 8, wherein the housing body and the cover can be connected via a dovetail guide.

11. The distributor block according to claim 8, wherein the contact guard is arranged between the housing body and the cover.

12. The distributor block according to claim 8, wherein the latching cams are arranged at the cover and the reinforcement ribs of the contact guard are arranged towards the first wall of the housing body.

* * * * *